US006766777B2

(12) United States Patent
Simpson et al.

(10) Patent No.: US 6,766,777 B2
(45) Date of Patent: Jul. 27, 2004

(54) METHOD TO ENSURE ROBUST OPERATION OF A PIN LOCK IN A VANE STYLE CAM PHASER

(75) Inventors: Roger Simpson, Ithaca, NY (US); Marty Gardner, Ithaca, NY (US)

(73) Assignee: BorgWarner, Inc., Auburn Hills, MI (US)

( * ) Notice: Subject to any disclaimer, the term of this patent is extended or adjusted under 35 U.S.C. 154(b) by 0 days.

(21) Appl. No.: 10/440,732

(22) Filed: May 19, 2003

(65) Prior Publication Data

US 2004/0025822 A1 Feb. 12, 2004

Related U.S. Application Data

(60) Provisional application No. 60/389,067, filed on Jun. 14, 2002.

(51) Int. Cl.[7] ..... F01L 1/34

(52) U.S. Cl. ..... 123/90.15; 123/90.16; 123/90.17; 123/90.31

(58) Field of Search ..... 123/90.15, 90.16, 123/90.17, 90.18, 90.27, 90.31; 464/1, 2, 160

(56) References Cited

U.S. PATENT DOCUMENTS

| | | | | |
|---|---|---|---|---|
| 5,943,989 | A * | 8/1999 | Kira | 123/90.17 |
| 6,460,496 | B2 * | 10/2002 | Fukuhara et al. | 123/90.17 |
| 6,481,402 | B1 | 11/2002 | Simpson et al. | 123/90.17 |
| 6,523,511 | B2 * | 2/2003 | Hase | 123/90.17 |

* cited by examiner

*Primary Examiner*—Thomas Denion
*Assistant Examiner*—Ching Chang
(74) *Attorney, Agent, or Firm*—Brown & Michaels, PC; Greg Dziegielewski

(57) ABSTRACT

A variable camshaft timing phaser having a locking pin directly influenced by engine oil, which is not impacted by any intervening valves. The locking pin is comprised of a tapered pin, which fits into a tapered recess. The locking pin is biased towards engaging by a spring, and is retracted by oil from the engine oil supply. The locking pin remains disengaged from the tapered recess as long as the oil pump is on.

2 Claims, 5 Drawing Sheets

METHOD TO ENSURE ROBUST OPERATION OF A PIN LOCK IN A VANE STYLE CAM PHASER

REFERENCE TO RELATED APPLICATIONS

This application claims an invention which was disclosed in Provisional Application No. 60/389,067, filed Jun. 14, 2002, entitled "A METHOD TO ENSURE ROBUST OPERATION OF A PIN LOCK WITH A CENTER MOUNTED SPOOL VALVE IN A VANE STYLE CAM PHASER". The benefit under 35 USC§119(e) of the United States provisional application is hereby claimed, and the aforementioned application is hereby incorporated herein by reference.

BACKGROUND OF THE INVENTION

1. Field of the Invention

The invention pertains to the field of variable camshaft timing (VCT) systems. More particularly, the invention pertains to a center mounted spool valve and a lock pin, which is fed directly with supply oil.

2. Description of Related Art

Internal combustion engines have employed various mechanisms to vary the angle between the camshaft and the crankshaft for improved engine performance or reduced emissions. The majority of these variable camshaft timing (VCT) mechanisms use one or more "vane phasers" on the engine camshaft (or camshafts, in a multiple-camshaft engine). In most cases, the phasers have a rotor with one or more vanes, mounted to the end of the camshaft, surrounded by a housing with the vane chambers into which the vanes fit. It is possible to have the vanes mounted to the housing, and the chambers in the rotor, as well. The housing's outer circumference forms the sprocket, pulley or gear accepting drive force through a chain, belt or gears, usually from the crankshaft, or possibly from another camshaft in a multiple-cam engine.

In an effort In traditional systems the locking pin is present in the vane of the phaser. Taking pressure (control pressure) from either the advanced or retard chamber, or a combination of both disengages the locking pin.

A traditional system as shown in prior art FIGS. 1 and 2 comprises an oil pump (10) that provides supply oil to a remotely located spool valve (14) in the engine block (16). The spool valve (14) is controlled by a variable force solenoid (12). Oil lines (18)(20) present in the engine block (16) are supplied with oil from the spool valve (14) and lead into a bearing (22) located on the camshaft (26). The lines (18)(20) continue through the bearing (22) and the camshaft (26) until they terminate in the phaser (24). The two lines are present in the phaser vane, one leading to the retard chamber **(17*b*) and one leading to the advanced chamber (17*a*)**, labeled R and A respectively.

In order to prevent motion of the phaser when oil pressure is too low to hold position, a locking pin is often provided. The locking pin (30) of the system can be located in the vane (28) or in the rotor or housing. The locking pin is disengaged from the rotor (not shown) by taking the oil pressure from either the advance or retard chambers or a combination of the two. In an effort to reduce the oscillation of the phaser due to cam torsionals of a remotely mounted spool valve in a traditional system as described below, the spool valve overlap is increased to reduce the flow from the chamber to chamber. In such a system as described, the locking pin (30) only receives partial oil pressure. The partial oil pressure is due to the fact that the oil must travel through the spool valve (14) located in the engine block (16), through lines (18)(20) in both the engine block (16) and the camshaft (26), and through the chambers **(17*a*)(17*b*) in the phaser (24)**. As the oil is made to travel further and further, and through more objects, for example through the cam bearings, chambers and the spool valve, the amount of oil lost due to leakage increases and the oil pressure is reduced significantly, so that by the time the oil reaches the locking pin in the above described system, the pressure is only partial.

Also, in an effort to reduce the oscillation of the phaser due to cam torsionals of a remotely mounted spool valve in a traditional system as described, the spool valve overlap is increased to reduce the flow from the chamber to chamber. The reduction of the flow of oil reduces the pressure of the oil that keeps the locking pin disengaged from the rotor. With the reduction of flow, the locking pin can easily engage the rotor, especially if the vane is in the middle of travel.

In most prior art variable cam timing systems, the locking pin is controlled by the oil pressure in the advance or retard chambers, through an oil line from one or both chambers. These chambers pressurize with oil from the output of the spool valve. For example, in U.S. Pat. No. 6,481,402 the camshaft rotor carries a slidable pin that may be locked in a position with respect to the housing that prevents the movement of the rotor relative to the housing. The sliding action of the pin is controlled by the position of the spool valve that is slidable along its axis to selectively control the flow of engine oil into and out of the advance and retard chambers of the housing. Since the spool valve is controlling whether the pin is locked or not, the locking of the pin is not solely a function of engine oil pressure.

SUMMARY OF THE INVENTION

A variable camshaft timing phaser having a locking pin directly influenced by engine oil, which is not impacted by any intervening valves. The locking pin is comprised of a tapered pin, which fits into a tapered recess. The locking pin is biased towards engaging by a spring, and is retracted by oil from the engine oil supply. The locking pin remains disengaged from the tapered recess as long as the oil pump is on.

DETAILED DESCRIPTION OF THE INVENTION

In a variable cam timing (VCT) system, the timing gear on the camshaft is replaced by a variable angle coupling known as a "phaser", having a rotor connected to the camshaft and a housing connected to (or forming) the timing gear, which allows the camshaft to rotate independently of the timing gear, within angular limits, to change the relative timing of the camshaft and crankshaft. The term "phaser", as used here, includes the housing and the rotor, and all of the parts to control the relative angular position of the housing and rotor, to allow the timing of the camshaft to be offset from the crankshaft. In any of the multiple-camshaft engines, it will be understood that there would be one phaser on each camshaft, as is known to the art.

There are three common types of phasers, Cam Torque Actuated (CTA), Oil Pressure Actuated (OPA), and Torsion or Torque Assist (TA). In a CTA phaser, the variable cam timing system uses torque reversals in the camshaft caused by the forces of opening and closing engine valves to move the vane. Control valves are present to allow fluid flow from chamber to chamber causing the vane to move, or to stop the flow of oil, locking the vane in position. The CTA phaser has oil input to make up for losses due to leakage but does not use engine oil pressure to move the phaser.

In OPA or TA phasers, the engine oil pressure is applied to one side of the vane or the other, in the retard or advance chamber, to move the vane. The TA phaser adds check valves either one in each supply line to each chamber or one in the engine oil supply line to the spool valve. The check valves block oil pressure pulses due to torque reversals from propagating back into the oil system, and stop the vane from moving backward due to torque reversals. Motion of the vane due to forward torque effects is permitted.

As shown in the figures of the present invention, the spool (104) of the spool valve (109) is located within the rotor. Passageways lead oil from the spool valve to the chambers **(17*a*)(17*b*), as shown in the figures. Since the spool valve (109) is in the rotor and not the camshaft (26), the camshaft (26) is much easier to manufacture, since fluid only needs to travel through the phaser into the spool valve (109) in the rotor—no elaborate passages need be machined into the camshaft (26), and no externally mounted valves are needed. Having the spool valve (109)** in the rotor reduces leakage and improves the response of the phaser. This design allows for shorter fluid passages when compared to a control system mounted at the cam bearing. Furthermore, by moving the spool to the center of a vane style phaser the lock pin can be fed directly with supply oil pressure rather than control oil pressure from either of the chambers, which can go from zero or near zero at null.

Figure 1:
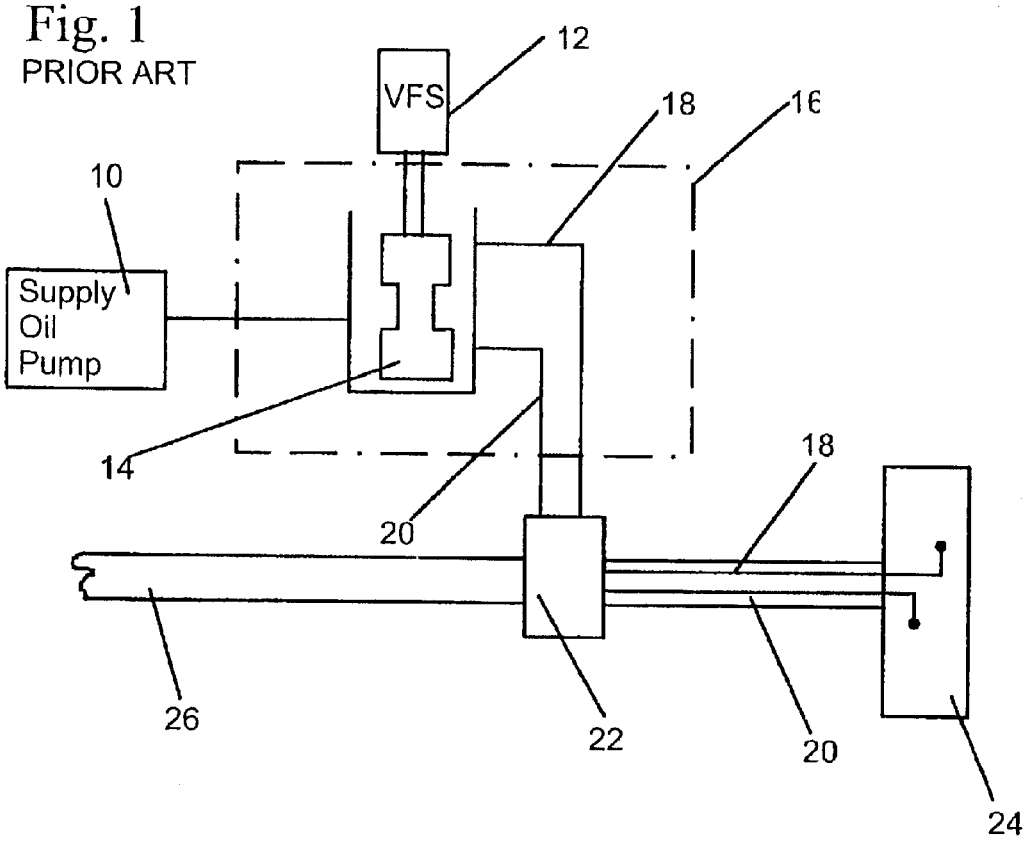
Fig. 1 PRIOR ART
FIG. 1 shows an intake phaser with a remote mounted control valve as known in the prior art.
Figure 2:
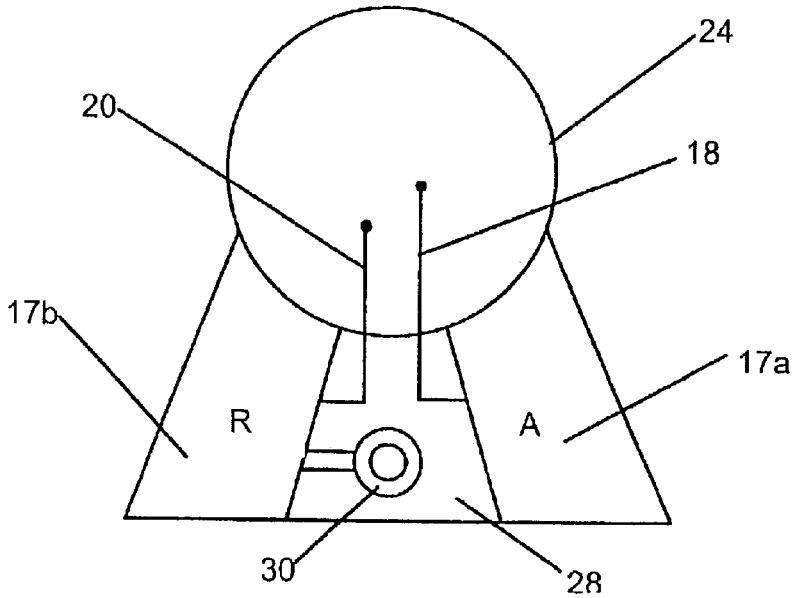
Fig. 2 PRIOR ART
FIG. 2 shows an alternate view of the prior art intake phaser of the present invention.
Figure 3:
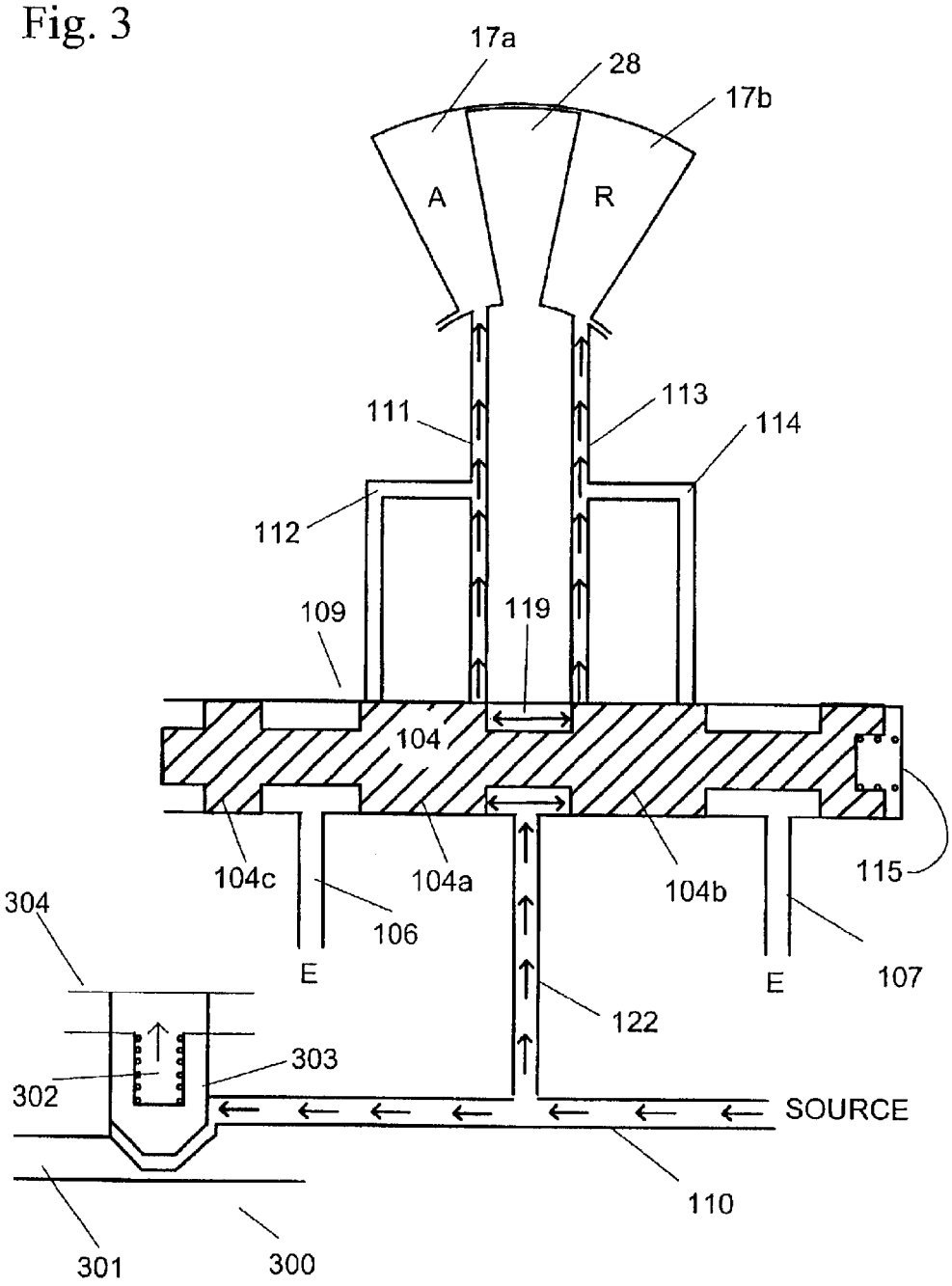
FIG. 3 shows a schematic of an oil pressure actuated (OPA) phaser in null position.

FIG. 3 shows the null position of an oil pressure actuated (OPA) phaser. The phaser operating fluid (122), illustratively in the form of engine lubricating oil that flows into the recesses **(17*a*) (labeled "A" for "advance") and (17*b*) (labeled "R" for "retard") is introduced into the phaser by way of a common inlet line (110). Inlet line (110) branches into two paths, one that terminates as it enters the spool valve (109) and another branch that terminates as it enters the locking pin (300). The spool valve (109) is made up of a spool (104) and a cylindrical member (115). The spool (104) is slidable back and forth and includes spool lands (104*a*), (104*b*), and (104*c*) which fit snugly within cylindrical member (115). The spool lands (104*a*), (104*b*), and (104*c*)** are preferably cylindrical lands and preferably have three positions, described in more detail below.

To maintain a phase angle, the spool (104) is positioned at null, as shown in FIG. 3. Make up oil from the supply fills both chambers **(17*a*) and (17*b*). When the spool (104) is in the null position, spool lands (104*a*) and (104*b*) block both of the return lines (112) and (114), as well as inlet lines (111) and (113). Since the hydraulic fluid (122) is essentially trapped in the center cavity (119) of the spool valve (109), the pressure is maintained, and hydraulic fluid (122) does not enter or leave either of the chambers (17*a*), (17*b*). However, there is inevitably leakage from the chambers (17*a*) and (17*b*). So, the spool valve is "dithered" to allow a small bit of movement. That is, the spool (104) wiggles back and forth enough so that if the advance (17*a*) and retard (17*b*) chambers begin losing pressure, make-up fluid (122) restores the pressure. However, the movement is not sufficient to let fluid out exhaust ports (106)(107). Center cavity (119)** is preferably tapered at the edges to allow easier transport of make-up fluid during dithering.

The locking pin (300) of the system is preferably located in the rotor (304), but might be in the housing. The locking pin (300) is comprised of a tapered pin (303), which fits into a tapered recess in the outer plate (301). The locking pin (300) is biased towards engaging the outer plate (301) by a spring (302). The locking pin (300) is supplied directly with source or supply oil by way of a common inlet line (110), which disengages the pin when oil pressure has built up on engine start. When the phaser is in null position, the locking pin (300) remains disengaged from the outer plate (301), so long as there is sufficient pressure in the common inlet line (110).

Figure 4:
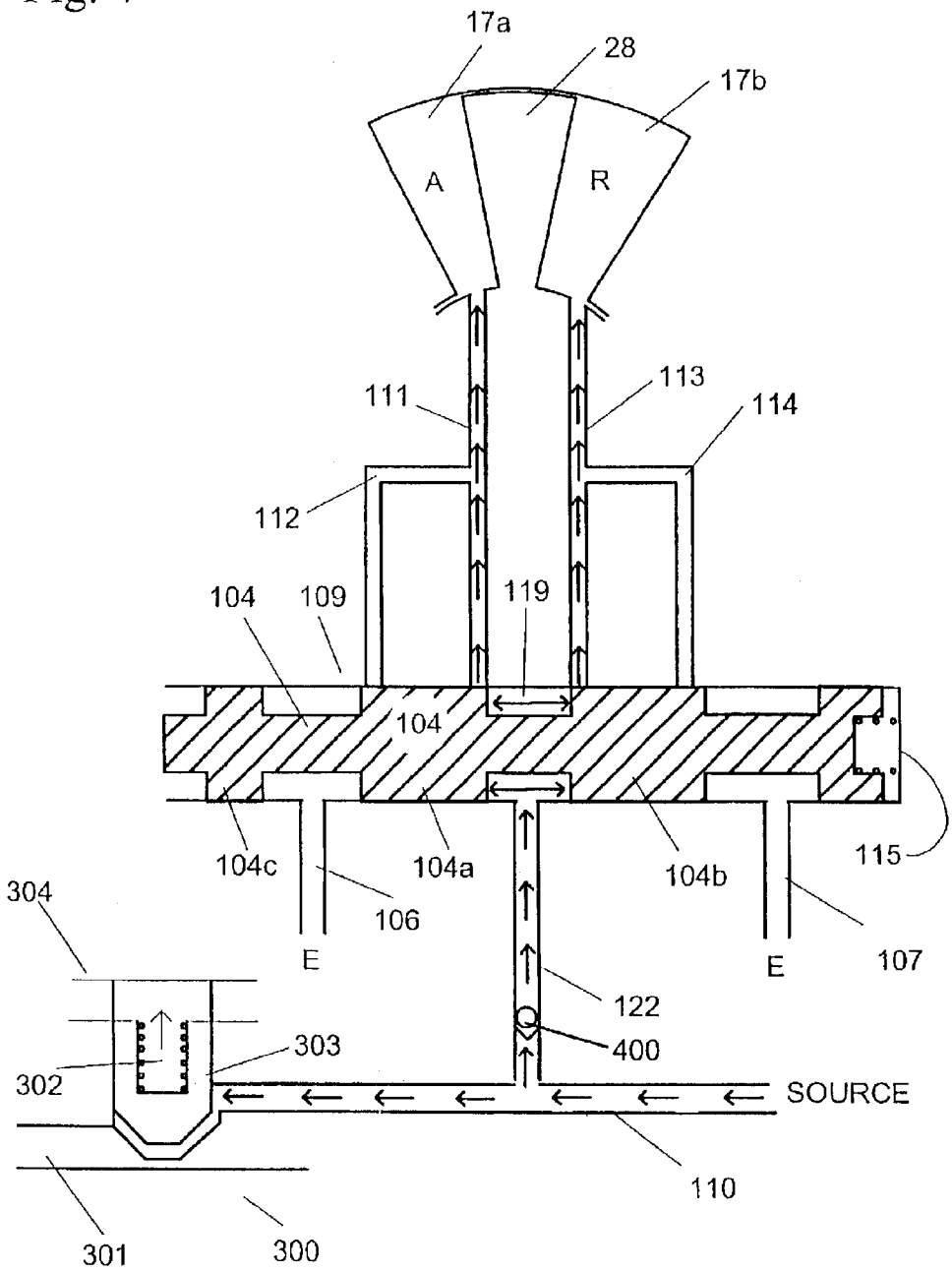
FIG. 4 shows a schematic of shows a schematic of a torsion assist (TA) phaser in the null position.

FIG. 4 shows a torsion assist phaser having a single check valve located in the inlet supply line. As shown, the spool (104) of the TA phaser is in null position. When the spool (104) is in the null position, spool lands **(104*a*) and (104*b*) block both of the return lines (112) and (114), as well as inlet lines (111) and (113). Since the hydraulic fluid (122) is essentially trapped in the center cavity (119) of the spool valve (109), the pressure is maintained, and hydraulic fluid (122) does not enter or leave either of the chambers (17*a*), (17*b*). However, there is inevitably leakage from the chambers (17*a*) and (17*b*). So, the spool valve is "dithered" to allow a small bit of movement. That is, the spool (104) wiggles back and forth enough so that if the advance (17*a*) and retard (17*b*) chambers begin losing pressure, make-up fluid (122) restores the pressure. However, the movement is not sufficient to let fluid out exhaust ports (106)(107). Center cavity (119) is preferably tapered at the edges to allow easier transport of make-up fluid during dithering. A single check valve (400) is located within the branch of the inlet line (110) that terminates as it enters the spool valve (109). The check valve blocks oil pressure pulses due to torque reversals from propagating back into the oil system and stops the vane (16)** from moving backward due to torque reversals.

The locking pin (300) of the system is preferably located in the rotor (304), but might be in the housing. The locking pin (300) is comprised of a tapered pin (303), which fits into a tapered recess in the outer plate (301). The locking pin (300) is biased towards engaging the outer plate (301) by a spring (302). The locking pin (300) is supplied directly with source or supply oil by way of a common inlet line (110), which disengages the pin when oil pressure has built up on engine start. When the phaser is in null position, the locking pin (300) remains disengaged from the outer plate (301), so long as there is sufficient pressure in the common inlet line (110).

Figure 5:
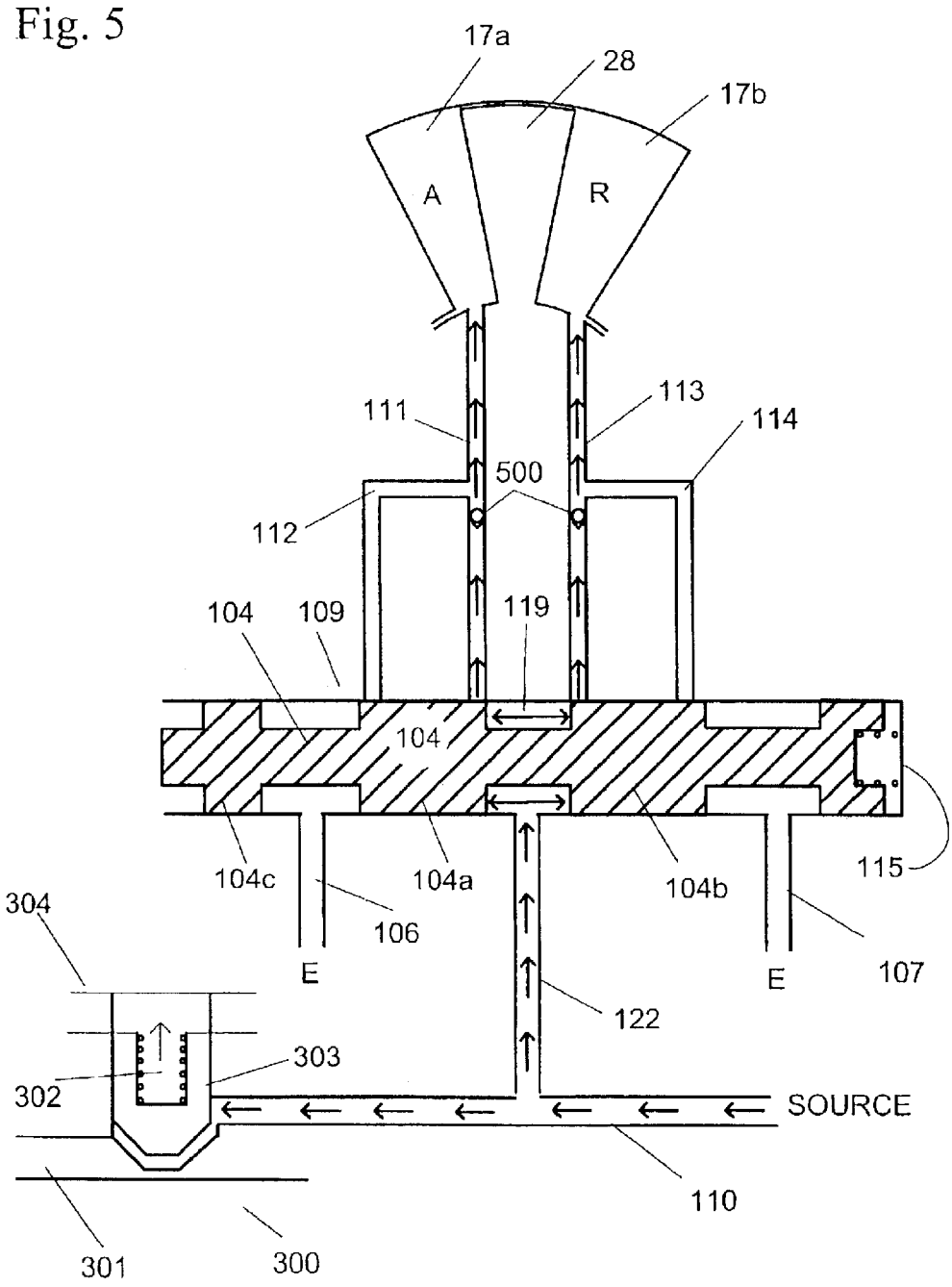
FIG. 5 shows a schematic of a schematic of another embodiment of a torsion assist (TA) phaser in null position.

FIG. 5 discloses a torsion assist (TA) phaser that contains two check valves (500) present in the inlet lines (111), (113) leading in to the advanced and retard chambers **(17*a*), (17*b*), respectively. As stated above, the check valves block oil pressure pulsed due to torque reversals from propagating back into the oil system and stops the vane (16)** from moving backwards due to torque reversals.

The locking pin (300) of the system is preferably located in the rotor (304), but might be in the housing. The locking pin (300) is comprised of a tapered pin (303), which fits into a tapered recess in the outer plate (301). The locking pin (300) is biased towards engaging the outer plate (301) by a spring (302). The locking pin (300) is supplied directly with source or supply oil by way of a common inlet line (110), which disengages the pin when oil pressure has built up on engine start. When the phaser is in null position, the locking pin (300) remains disengaged from the outer plate (301), so long as there is sufficient pressure in the common inlet line (110).

Figure 6:
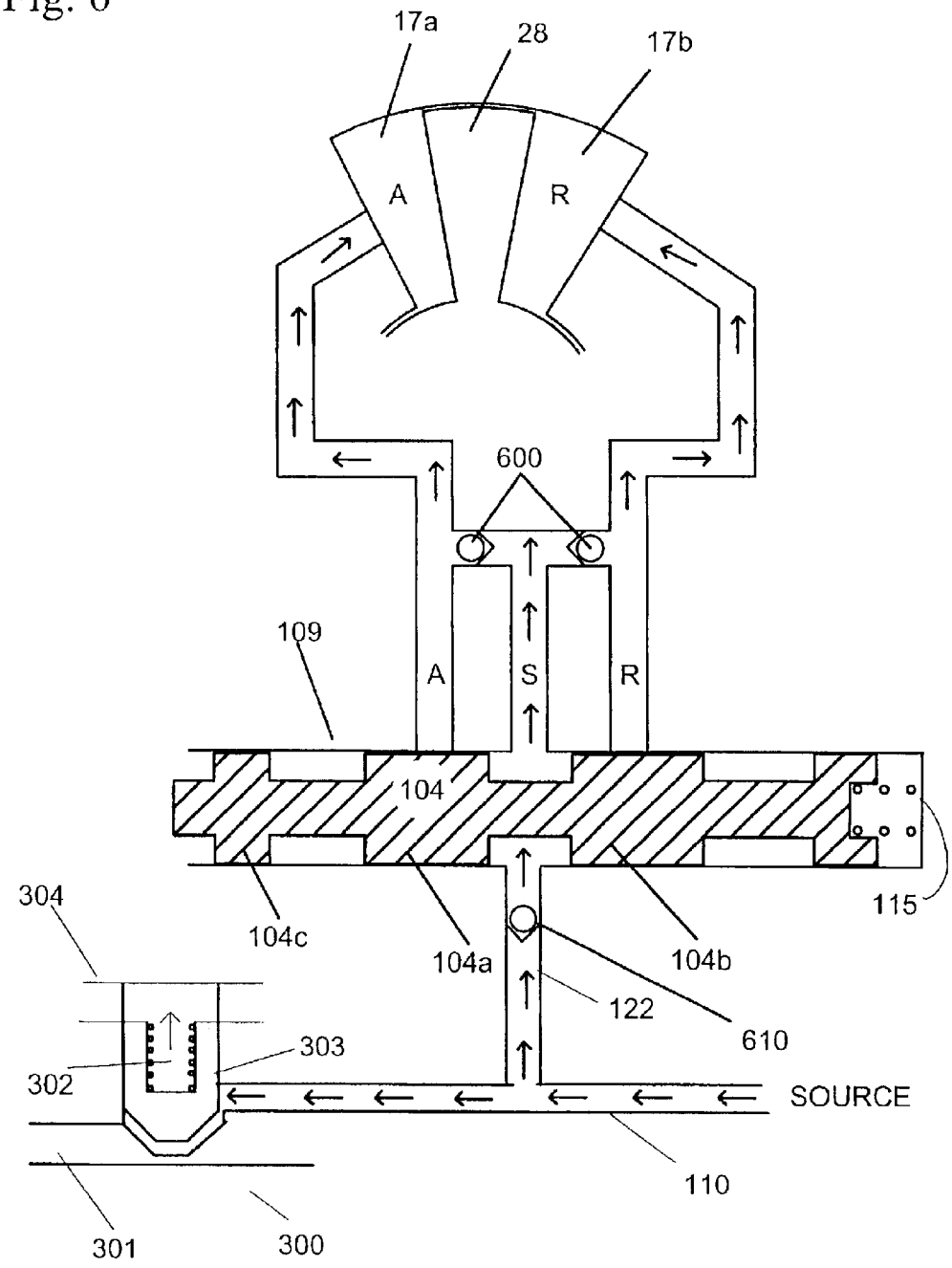
FIG. 6 shows a schematic of a cam torque actuated (CTA) phaser in the null position.

FIG. 6 discloses a cam torque actuated (CTA) phaser. The CTA phaser works by using torque reversals from the camshaft caused by the opening and closing of the engine valves. Check valves (600), (610) allows fluid flow from the advance to the retard chamber allowing the vane to move or stops the fluid flow. The CTA phaser has an oil input to make up for losses due to leakage but does not use engine oil pressure to move the phaser. The locking pin (300) of the system is located in the rotor (304). The locking pin (300) is comprised of a tapered pin (303), which fits into a tapered recess in the outer plate (301). The locking pin (300) is biased towards engaging the outer plate (301) by a spring (302). The locking pin (300) is supplied directly with source or supply oil by way of a common inlet line (110). When the phaser is in null position, the locking pin (300) remains disengaged from the outer plate (301).

The locking pin (300) of the system is preferably located in the rotor (304), but might be in the housing. The locking pin (300) is comprised of a tapered pin (303), which fits into a tapered recess in the outer plate (301). The locking pin (300) is biased towards engaging the outer plate (301) by a spring (302). The locking pin (300) is supplied directly with source or supply oil by way of a common inlet line (110), which disengages the pin when oil pressure has built up on engine start. When the phaser is in null position, the locking pin (300) remains disengaged from the outer plate (301), so long as there is sufficient pressure in the common inlet line (110).

In all types of phasers, the locking pin (300) will remain disengaged from the outer plate (301) as long as the oil pump is on and working and sufficient oil pressure is present. Therefore, the locking pin (300) remains in a disengaged state when the car is on, even when the spool valve is in null position. Since the locking pin is controlled by the oil from the engine oil pump and not the output of the spool, the locking pin may be used in all types of phasers, oil pressure actuated (OPA), torsion assisted (TA), and cam torque actuated (CTA). The locking pin (300) engages the outer plate (301) when the engine or the oil pump is shut off and oil pressure drops. It is also understood by one skilled in the art that the locking pin may be located in places other than the rotor.

Accordingly, it is to be understood that the embodiments of the invention herein described are merely illustrative of the application of the principles of the invention. Reference herein to details of the illustrated embodiments is not intended to limit the scope of the claims, which themselves recite those features regarded as essential to the invention.

What is claimed is:

1. A variable camshaft timing phaser for an internal combustion engine having at least one camshaft comprising:

a housing having an outer circumference for accepting drive force;

a rotor for connection to a camshaft coaxially located within the housing capable of rotation to shift the relative angular position of the housing and the rotor;

a locking pin in one of the housing or the rotor slidably located in a radial bore, comprising a body having a diameter adapted to a fluid-tight fit in the radial bore, and an inner end toward the housing with a tapered position adapted to fit in a tapered recess in the other housing or rotor, the locking pin being radially movable in the bore from a locked position in which the tapered end fits into the tapered recess, locking the relative angular position of the rotor and the housing, to an unlocked position in which the tapered end does not engage the rotor;

a spring located in the radial bore opposite the inner end of the locking pin, urging the locking pin radially inward toward the locked position; and an oil passage coupled directly to an engine oil supply such that the locking pin is directly influenced by engine oil, which is not influenced by any intervening valves, moves the locking pin against the spring.

2. A variable camshaft timing phaser for an internal combustion engine having at least one camshaft comprising: a housing having an outer circumference for accepting drive force, and a rotor for connection to a camshaft coaxially located within the housing capable of rotation to shift the relative angular position of the housing and the rotor, the improvement comprising:

a locking pin in one of the housing or the rotor slidably located in a radial bore, comprising a body having a diameter adapted to a fluid-tight fit in the radial bore, and an inner end toward the housing with a tapered position adapted to fit in a tapered recess in the other housing or rotor, the locking pin being radially movable in the bore from a locked position in which the tapered end fits into the tapered recess, locking the relative angular position of the rotor and the housing, to an unlocked position in which the tapered end does not engage the rotor;

a spring located in the radial bore opposite the inner end of the locking pin, urging the locking pin radially inward toward the locked position; and an oil passage coupled directly to an engine oil supply such that the locking pin is directly influenced by engine oil which is not influenced by any intervening valves and moves the locking pin against the spring.

* * * * *